United States Patent [19]

Goble

[11] Patent Number: 4,886,216

[45] Date of Patent: Dec. 12, 1989

[54] MILL FOR PULVERIZING ROCK AND OTHER MATERIAL

[76] Inventor: Ralph W. Goble, 21 Abernathy Ct., Highlands Ranch, Colo. 80126

[21] Appl. No.: 165,499

[22] Filed: Mar. 8, 1988

[51] Int. Cl.[4] ..... B02C 19/00

[52] U.S. Cl. ..... 241/152 R; 241/275; 241/285 R

[58] Field of Search ..... 241/275, 154, 188 R, 241/189 R, 81, 285 R, 300, 152 R

[56] References Cited

U.S. PATENT DOCUMENTS

| | | | |
|---|---|---|---|
| 134,513 | 1/1873 | Chichester . | |
| 248,923 | 11/1881 | Dechamp . | |
| 1,212,418 | 1/1917 | Sturtevant . | |
| 1,212,419 | 1/1917 | Sturtevant . | |
| 1,636,033 | 7/1927 | Agnew | 241/275 X |
| 1,656,756 | 1/1928 | Payne . | |
| 1,758,010 | 5/1930 | Pettinos . | |
| 1,911,193 | 5/1933 | Hill . | |
| 3,088,685 | 5/1963 | Bridgewater | 241/275 X |
| 3,987,970 | 10/1976 | Burkett . | |
| 4,093,127 | 6/1978 | Alberts et al. | 241/275 X |
| 4,144,167 | 3/1979 | Burkett et al. . | |
| 4,151,794 | 5/1979 | Burkett . | |
| 4,493,459 | 1/1985 | Burkett . | |

OTHER PUBLICATIONS

Barmac Rotopactor, 12-1985.

F. L. Smidth, Sepax Separator.

Pit and Quarry, 12-1987, p. 95.

Pennsylvania Cement Maker Seeks Peak Performance, Pit and Quarry, 12-1987, pp. 60-62.

*Primary Examiner*—Mark Rosenbaum

[57] ABSTRACT

A mill for pulverizing rock and other material. The mill includes a series of rings each having nine flat faces extending around the interior surface of the ring. The rings are arranged in a vertical column. A baffle plate possessing a central aperture is disposed between each pair of adjacent rings. A vertically extending axle extends through each of the central apertures of the baffles. A rotor is disposed between each pair of adjacent baffles and is mounted on the axle for concurrent rotation therewith. The periphery of each rotor possesses a plurality of curved blades so that when the axle is rotated, the rotor creates a suction force, which hurls the rocks forcibly toward the flat surfaces of the rings. Some of the rocks ricochet off the flat surfaces and collide into the rocks being hurled toward the flat surfaces, which collision causes the rocks to break apart. The rocks are delivered into the top of the mill, are hurled by the top-most rotor toward the faces of a ring, pass through the central aperture of the lower, adjacent baffle plate, are hurled by the next lower rotor toward the faces of the next lower ring, etc., in continuous operation until the rocks are disintegrated to the desired particle size.

28 Claims, 5 Drawing Sheets

FIG.7
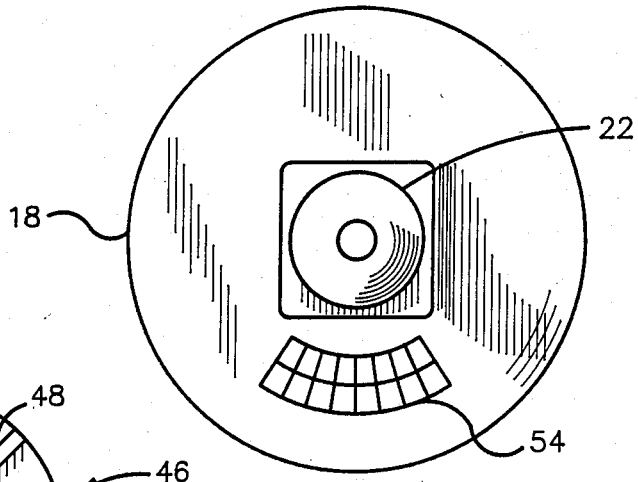
FIG.8
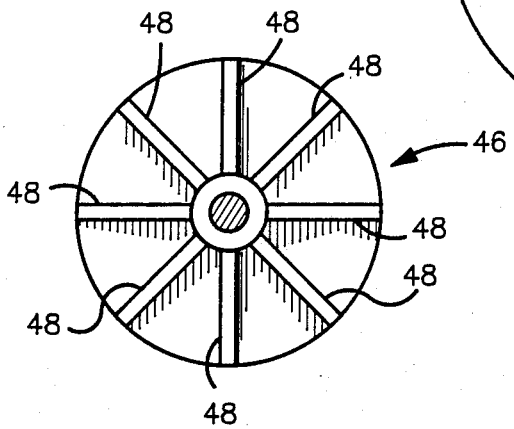
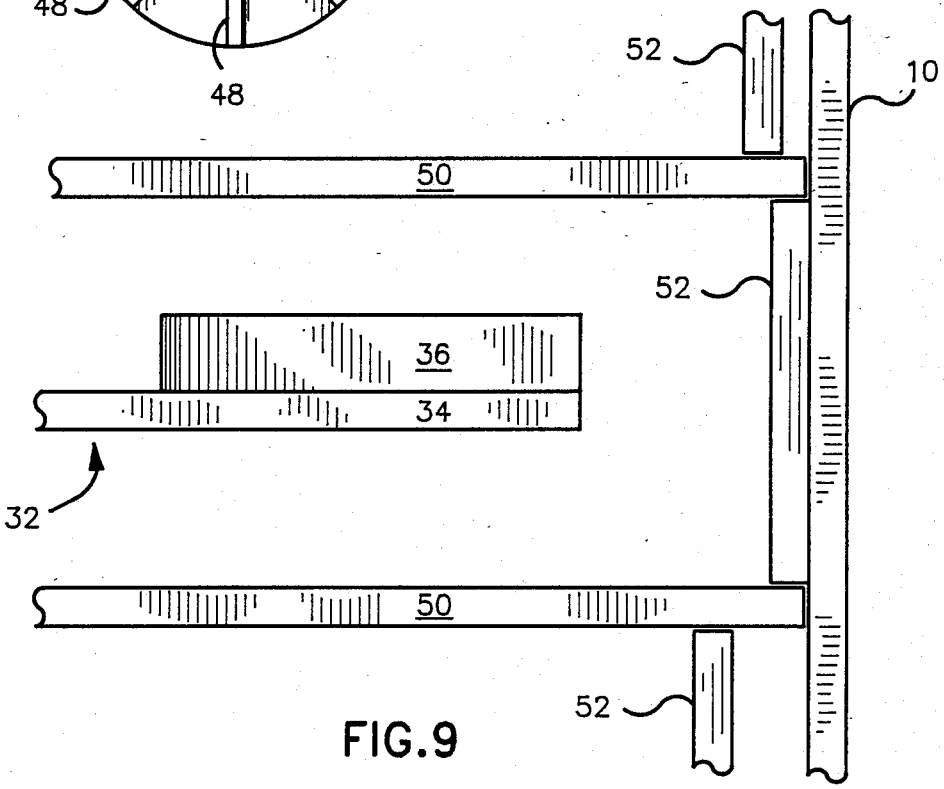
FIG.9

MILL FOR PULVERIZING ROCK AND OTHER MATERIAL

BACKGROUND OF THE INVENTION

The present invention relates to a mill for pulverizing rock and other material.

Rock is pulverized for a variety of purposes, one of which is to reduce the size of rock particles so that they may be effectively treated with chemicals to remove precious minerals contained therein. The degree of precious mineral recovery is inversely proportional to the size of the rock particles. Most mills for pulverizing rock utilize large and expensive pieces of machinery which take a very long time to pulverize rock into small particles, consume great quantities of energy, and usually do not create rock particles of uniformly small size. Also, most rock mills deteriorate quickly from wear and are prone to break down.

The mill of the present invention pulverizes rock extremely quickly, with a minimal expenditure of energy. The resulting rock particles are of relatively uniform, extremely small size — even finer than wheat flour. The mill experiences almost no wear or deterioration and possesses essentially one moving part, thereby requiring negligible maintenance.

SUMMARY OF THE INVENTION

The present invention relates to a mill for pulverizing rock and other material. The mill includes a series of rings each having nine flat faces extending around the interior surface of the ring. The rings are arranged in a vertical column. A baffle plate possessing a central aperture is disposed between each pair of adjacent rings. A vertically extending axle extends through each of the central apertures of the baffles. A rotor is disposed between each pair of adjacent baffles and is mounted on the axle for concurrent rotation therewith. The periphery of each rotor possesses a plurality of curved blades so that when the axle is rotated, the rotor creates a suction force, which hurls the rocks forcibly toward the flat surfaces of the rings. Some of the rocks ricochet off the flat surfaces and collide into the rocks being hurled toward the flat surfaces, which collision causes the rocks to break apart. The rocks are delivered into the top of the mill, are hurled by the top-most rotor toward the faces of a ring, pass through the central aperture of the lower, adjacent baffle plate, are hurled by the next lower rotor toward the faces of the next lower ring, etc. in continuous operation until the rocks are disintegrated to the desired particle size.

BRIEF DESCRIPTION OF THE DRAWINGS

The invention will be described with reference to the accompanying drawings wherein:

FIG. 7 is a top view of the top cover of the mill depicted in FIG. 1;

FIG. 8 is a top view of a dispersing rotor used in the mill depicted in FIG. 1;

FIG. 9 is a partial cross-sectional view of the mill depicted in FIG. 1;

DESCRIPTION OF A PREFERRED EMBODIMENT

Figure 1:
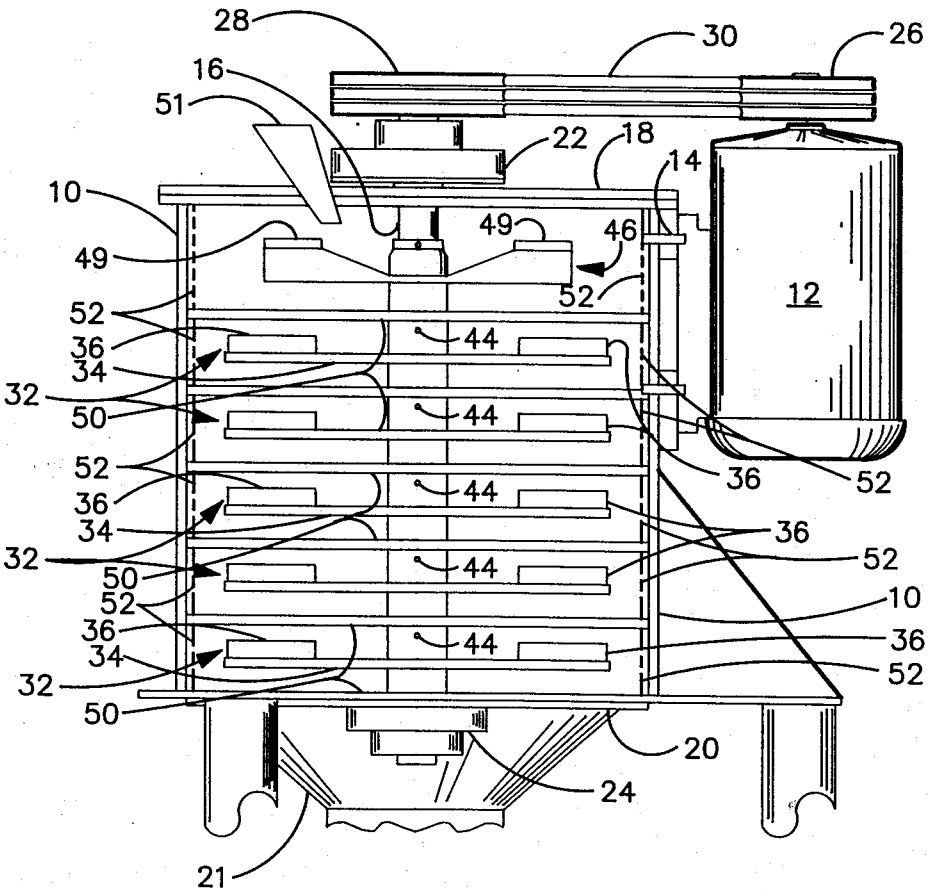
FIG. 1 is a schematic cross-sectional view of a mill in accordance with one embodiment of the present invention.
Figure 2:
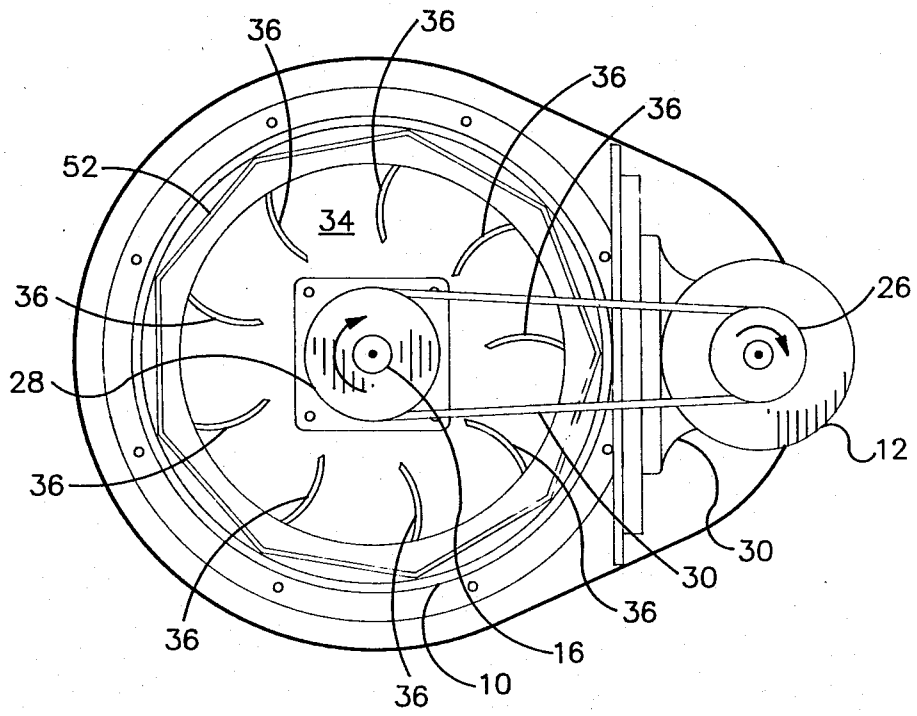
FIG. 2 is a schematic top view of the mill shown in FIG. 1 with the top cover, the dispersing rotor, and the top-most baffle plate removed.

The present will be described with reference to the accompanying drawings wherein like reference numerals refer to the same item. There is shown in FIGS. 1 and 2 a mill for pulverizing rock and other material. The mill includes a cylindrical, hollow container 10 having a cylindrical interior surface possessing a diameter of twenty-four inches and a height of twenty-three and one-eighth inches. A twenty horsepower electric motor 12 is mounted by bolts 14 to the container 10. A rotatable axle 16 extends centrally through the container 10, along the longitudinal axis thereof. The interior of the container 10 is enclosed by a top cover 18 and a bottom cover 20, each of which is provided with apertures. A funnel 21 is disposed below the bottom cover 20. The axle 16 extends through the top cover 18 and the bottom cover 20 and is journaled in a pair of corresponding ball bearing mountings 22, 24. A first series of pulleys 26 are mounted on the drive shaft of the motor 12 and a second series of pulleys 28 are mounted on the top end of the axle 16. The two sets of pulleys 26, 28 are operably connected by a series of endless drive belts 30 so that the motor 12 rotates the axle 16.

Figure 3:
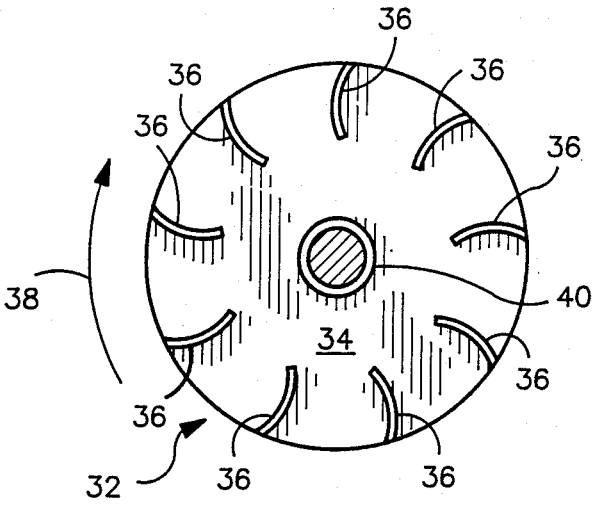
FIG. 3 is a top view of a rotor used in the mill depicted in FIG. 1.
Figure 4:
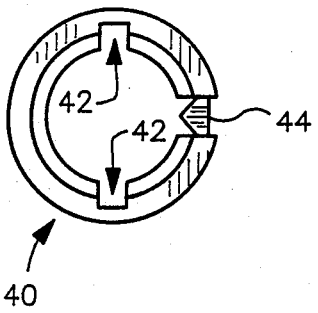
FIG. 4 is a top view of the hub of the rotor shown in FIG. 3.
Figure 5:
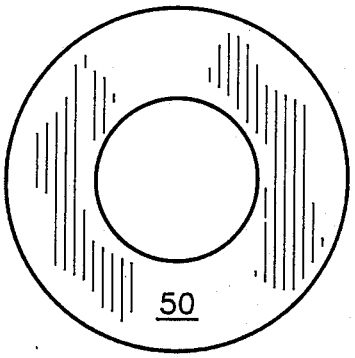
FIG. 5 is a top view of a baffle plate used in the mill depicted in FIG. 1.

The mill also includes five rotors 32 fixedly mounted on the axle 16 equidistantly from each other. Each rotor 32 includes a cylindrical plate 34 having a diameter of twenty inches. Preferably the plate 34 is fashioned of steel and is three-eighths inch thick. Each rotor 32 also includes a plurality of curved blades 36 equiangularly spaced about the periphery of the plate 34. Although the rotor 32 depicted in FIG. 3 includes nine blades 36, it should be appreciated that other numbers of blades 36 may be advantageously used in connection with the present invention. Each blade 36 is one inch high, is five and one-half inches long, and is curved with a radius curvature of four and one-half inches. The blades 36 are preferably fashioned of steel and are mounted by welding to the circular plate 34 so that their curvatures face in the same radial direction. The blades 36 are all mounted on the same side of the plate 34 and the rotors 32 are mounted on the axles 16 such that the blades 36 are disposed on the upper surface of each plate 34, as best shown in FIG. 1. The rotor 32 is designed to rotate in the direction of the arrow 38 as shown in FIG. 3. The blades 36 may be mounted on either the top or the bottom side of the plate 34, with the curvature of the blades 36 being opposite to that shown in FIG. 3 when mounted on the bottom side of the plate 34.

Each rotor 32 also includes a hub 40. The hub is mounted such as by welding to the plate 34 on the same side of the plate 34 as are the blades 36. Each hub 40 includes a pair of keyways 42 for mating with a pair of corresponding keys (not shown) on the axle 16 so that the rotor 32 rotates concurrently with the axle 16. Each hub 40 also includes a set screw 44 which may be advantageously used in a well known manner to selectively position the rotor 32 vertically along the axle 16.

A dispersing rotor 46 is also mounted on the axle 16, within the container 10, as best shown in FIG. 1. The dispersing rotor 46 is designed and constructed very much like the rotor 32 except that the diameter of the rotor is smaller, and the dispersing rotor 46 possesses eight straight, radially extending, equiangularly spaced blades 48. As best shown in FIG. 1, each blade 48 is beveled on its radially inward end to improve the air pumping characteristics of the dispensing rotor 46. A ring-like plate 49 is mounted over the blades 48 such that the central aperture of the ring-like plate 49 exposes the beveled ends of the blades 48. The ring-like plate 49 also improves the air pumping characteristics of the dispensing rotor 46. The dispersing rotor 46 is mounted on the axle 16 in the same manner as the rotors 32. A chute 51 extends through the aperture in the top cover 18 such that the discharge end of the chute 51 is disposed above the central aperture of the ring-like plate 49.

The mill also includes five equidistantly spaced baffles 50, each of which is disposed above a corresponding rotor 32. Each baffle 50 possesses a circular shape with a diameter of twenty-four inches — equal to the diameter of the inner surface of the container 10. Each baffle also possesses a central, circular aperture having a diameter of ten inches, which is seven inches greater than the diameter of the axle 16. Each baffle 50 is preferably fashioned of a steel plate having a thickness of three-eighths inches. Adjacent baffles 50 are separated by a distance of three inches, and the circular plate 34 of a rotor 32 is separated from an adjacent, lower baffle 50 by a distance of seven-eighths inches.

Figure 6:
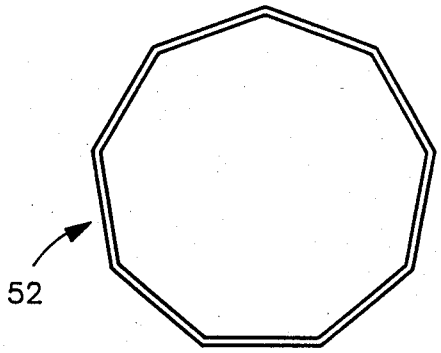
FIG. 6 is a top view of a ring used in the mill depicted in FIG. 1.

The mill also includes six rings 52. Each ring 52 is fashioned from nine identical rectangular pieces of steel plate welded together at their adjacent edges. Preferably the steel plate is three-eighths inches thick. As best shown in FIG. 6, the steel plates of the ring 52 form equiangular and equidistant chord of a circle. Such circle has a diameter of twenty-four inches so that the ring may be snugly inserted within the container 10, with the external corners of the ring 52 contacting the inner surface of the container 10, as best shown in FIG. 2. The preferred number of steel plates is nine, but a mill has been less advantageously used with eight steel plates and with twelve steel plates. Also, a mill does not work nearly as well with completely circular rings. The inventor is unable to explain why a ring of flat surfaced faces works better than a circular ring, or why a ring having nine flat surfaced faces works better than rings having a different number of flat surfaced faces. Five of the rings 52 are each three inches in height, and the sixth ring is significantly greater in height. As best shown in FIG. 1, each of the five rings 52 of equal height are mounted in a vertical column within the container 10, with a corresponding baffle 50 interposed between adjacent rings 52. The sixth ring of greater height is mounted above the uppermost baffle 50.

It should thus be appreciated that the rings 52 and the baffles 50 are mounted within the container 10 without being attached to each other and without being attached to the container 10. This stacking arrangement facilitates quick and easy assembly and disassembly of the mill and also permits ready and inexpensive replacement of any damaged or worn portion of the mill. It will also be appreciated that the mill of the present invention is relatively small and compact.

In operation, the material such as rock is delivered through the chute 51 extending through an aperture in the top cover 18. A grating 54 covers the aperture so that only rocks of less than a predetermined size are permitted to enter the mill. Alternately, the grating 54 may be incorporated into the chute 51. The rock drops down onto the radially inner region of the dispersing rotor 46, which slings the rocks radially outward toward the top-most ring 52. The rocks then progress toward the center of the top-most baffle 50, drop down through the central aperture of the top-most baffle 50, and are flung by the top-most rotor 32 radially outward toward the next lower ring 52. This sequence is repeated until the rock eventually falls through the apertures in the bottom cover 20 and into the funnel 21. Each time the rocks impinge upon the flat faces of the inner surface of the rings 52, the rocks ricochet and collide with the rocks being hurled toward the ring 52, which collision causes the rocks to crack, break apart, and disintegrate. The relatively thin steel walls of the rings 52 are believed to act in a resilient manner like a trampoline. Consequently it is further believed that an insubstantial disintegration of the rocks occurs because of contact with the rings 52. The rock particles are of a more uniform and small size during a continuous feed operation as compared with a small batch operation, thereby tending to confirm that disintegration is substantially caused by rock-rock rather than rock-ring collisions.

The foregoing type of mill has been used to pulverize stream bed rock, glass bottles, granite, quartz, and cement clinkers of no greater than about one-half inch diameter, with the axle rotating at about 2,500 rpm's, which causes the rotors 32 to have a peripheral speed of about 224 feet per second. Such rock was pulverized within a matter of seconds and exited the mill in a uniformly fine powder having a particle size of approximately 200 mesh. Analysis of the powder particles under a microscope revealed that the particles are porous and possess rough edges. Thus, the rock is not ground, but apparently sharply compresses due to the collision and quickly relaxes or rebounds after the collision, which causes the rock literally to explode. Experiments have demonstrated that the particle size of the pulverized rock is inversely proportional to the speed of axle rotation and that the powder size is inversely proportional to the hardness of the rock, thereby indicating that the sharpness of the shock wave upon collision is directly proportional to the degree of disintegration. Experiments have also demonstrated that there appears to be very little or no abrasion or wear on the axle, the rotor plate or the rotor blades. Consequently, it is believed that the rotors 32 and dispersing rotor 46 create an immense draft of air through the system, which tends to carry and suspend the rock particles along their path through the mill.

Such a mill has also been used to pulverize chunks of an aluminum can, but the resulting particles of aluminum were of varying sizes, ranging from a fine powder to small pellets.

Figure 10:
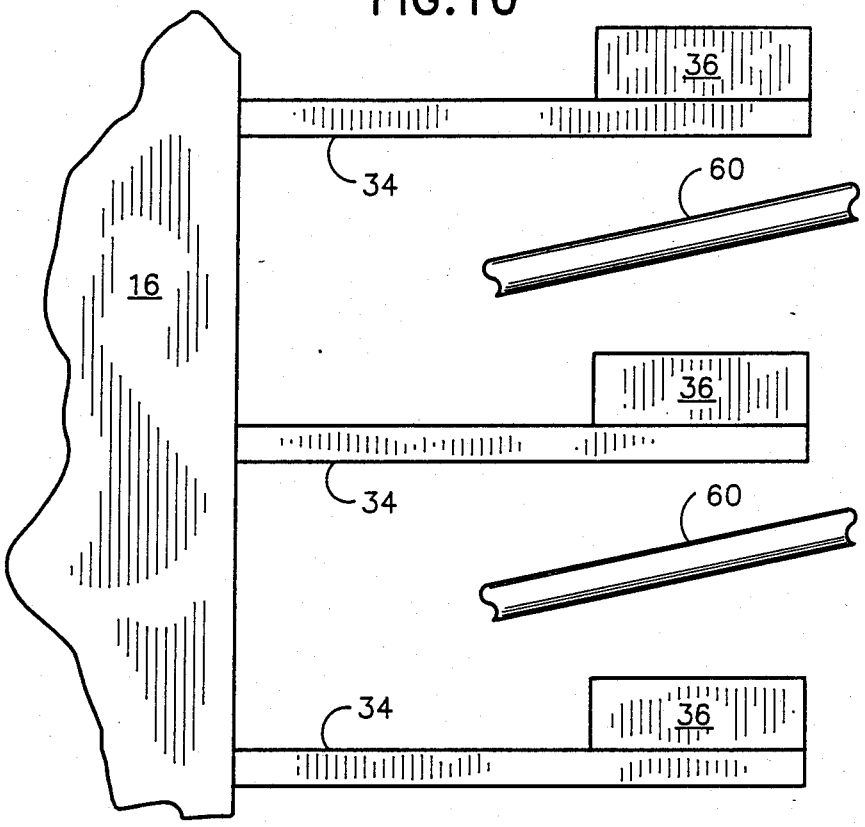
FIG. 10 is a schematic partial cross-sectional view of the mill shown in FIG. 1 utilizing a different baffle plate.

There is shown in FIG. 10 a slightly modified embodiment of the mill shown in FIG. 1. Instead of the baffle plates 50 being horizontally disposed and parallel to the circular plates 34 of the rotors 32, the baffle plates 60 in the modified mill shown in FIG. 10 are inclined with respect to the circular plates 34 of the rotors 32. Hence, the baffle plates 60 are frustoconical in shape, rather than planar. The inclination of the baffle plates 60 serves to minimize and eliminate back pressure in the air flow through the mill. In the mill shown in FIG. 1, some back pressure exists due to the need to compress the air (into a smaller region of space) as the air moves between an upper rotor 32 and a lower baffle plate 50 toward the axle 16. The inclined baffle plate 60 creates a space such that the air is not forced into a smaller region. Ideally, the inner peripheral edge of the baffle plate 60 is disposed midway between adjacent rotors 34, again, so that the air flow does not need to be forced through any constricted regions.

Figure 11:
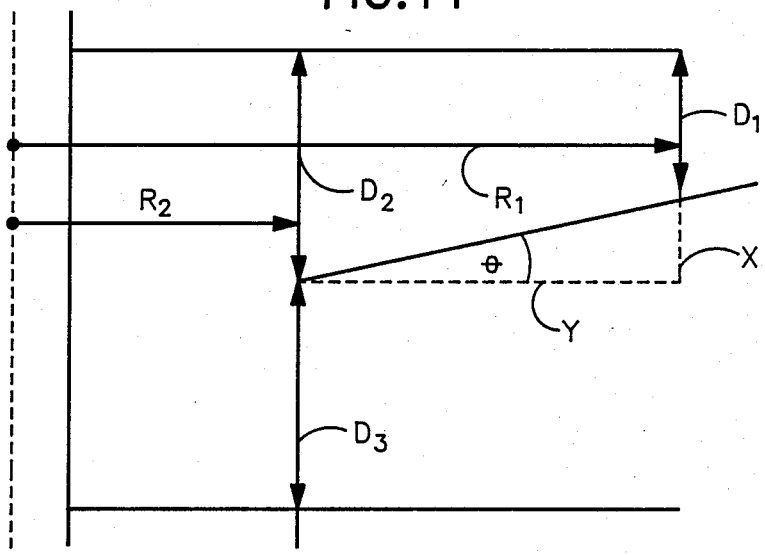
FIG. 11 is a schematic illustration depicting the dimensions for determining an optional angle of inclination of the baffle plate shown in FIG. 10 in order to minimize back pressure.

The concept of minimizing back pressure may be appreciated by reference to FIG. 11, which schematically illustrates the dimensions for determining an optimal angle of the inclination of the baffle plate 60. The dimensions indicated in FIG. 11 are as follows:

$D_1$ is the vertical distance between the outer peripheral edge of the circular plate 34 of the upper rotor 32, and the inclined baffle 60 therebelow.

$R_1$ is the radial distance of the outer peripheral edge of the circular plate 34 of the upper rotor 32 from the axis of the axle 16.

$D_2$ is the vertical distance between the inner peripheral edge of the baffle plate 60 and the circular plate 34 of the upper rotor 32.

$R_2$ is the radial distance of the inner peripheral edge of the baffle plate 60 from the axis of the axle 16.

$D_3$ is the vertical distance between the inner peripheral edge of the baffle plate 60 and the circular plate 34 of the lower adjacent rotor 32.

Ideally, as explained above, $D_2$ equals $D_3$ in order to minimize any constricted flow regions. In order for back pressure to be minimized, the following relationship must exist between annulus areas:

$$2\pi R_1 D_1 = 2\pi R_1 D_1$$

$D_1$ may be expressed as a function of $D_2$ as follows:

$$D_1 = \frac{2\pi R_2 D_2}{2\pi R_1} = \frac{R_2 D_2}{R_1}$$

The angle of inclination $\Theta$ may be expressed as follows:

$$\tan\theta = \frac{X}{Y} = \frac{D_2 - D_1}{R_1 - R_2} = \frac{D_2 - \frac{R_2 D_2}{R_1}}{R_1 - R_2} = \frac{D_2\left(1 - \frac{R_2}{R_1}\right)}{R_1 - R_2}$$

The inclination of the angle of the baffle plate 60 for the preferred embodiment of the present invention described above may be calculated as follows:

$$R_1 = \frac{20 \text{ inches}}{2} = 10 \text{ inches}$$

$$R_2 = \frac{10 \text{ inches}}{2} = 5 \text{ inches}$$

$$D_2 + D_3 = 3 \text{ inches}$$

$$D_2 = D_3$$

$$D_2 - D_3 = 0$$

$$D_2 = 1.5 \text{ inches}$$

$$\tan\theta = \frac{1.5 \text{ inches}\left(1 - \frac{5 \text{ inches}}{10 \text{ inches}}\right)}{10 \text{ inches} - 5 \text{ inches}} = \frac{1.5 \text{ inches } (.5)}{5 \text{ inches}} = .15$$

$$\theta = 8.5 \text{ degrees}$$

It should be appreciated that the numbers of rotors 32, baffles 50, and rings 52 may be more or less than the numbers described in the preferred embodiment and depicted in FIG. 1.

Although particular embodiments of the present invention have been described and illustrated herein, it should be recognized that modifications and variations may readily occur to those skilled in the art and that such modifications and variations may be made without departing from the spirit and scope of my invention. Consequently, my invention as claimed below may be practiced otherwise than as specifically described above.

I claim:

1. A mill for pulverizing rock and other material comprising:

a hollow container having a substantially cylindrical interior surface, said container having a top longitudinal end and a bottom longitudinal end and having a central longitudinal axis;

a rotatable axle extending into said container substantially coextensive with said central longitudinal axis;

a rotor including a substantially circular, flat plate and a plurality of blades mounted about the outer periphery of said plate, said rotor mounted centrally on said axle and adapted for concurrent rotation therewith;

at least two substantially circular baffles, each baffle possessing a central aperture, the outside diameter of each said baffle being substantially equal to the inside diameter of said container interior surface and the central aperture of each said baffle being larger than the diameter of said axle, said axle extending through said central aperture of each said baffle, said rotor being disposed between said baffles, said rotor and said baffles being oriented substantially perpendicular to said central longitudinal axis;

a ring adapted to surround said rotor in a spaced relation from said rotor, the inner surface of said ring provided with a plurality of interconnected substantially flat faces, each face substantially coplanar with the chord of a circle whose center substantially coincides with said central longitudinal axis, whereby rock or other material may pass between the inner periphery of a top-most baffle and said axle, between said top-most baffle and said rotor, between the outer periphery of said rotor and said ring, between said rotor and a bottom-most baffle, and between the inner periphery of said bottom-most baffle and said axle.

2. A mill according to claim 1 wherein the inner surface of said ring is provided with at least five and less than fourteen substantially flat faces.

3. A mill according to claim 2 wherein the inner surface of said ring is provided with at least seven and less than twelve substantially flat faces.

4. A mill according to claim 3 wherein the inner surface of said ring is provided with nine substantially flat faces.

5. A mill according to claim 1 wherein the outer surface of said ring contacts the inner surface of said container.

6. A mill according to claim 1 wherein said ring is disattached from said container.

7. A mill according to claim 1 wherein each said baffle is disattached from said container.

8. A mill according to claim 1 wherein said faces substantially entirely cover the inner surface of said ring.

9. A mill according to claim 1 wherein each of said faces possesses dimensions substantially identical to the dimensions of the others of said faces.

10. A mill according to claim 1 wherein the top longitudinal end of said container is covered with a grating adapted to prevent rock or other material greater than a predetermined size to pass therethrough and into the interior of said container.

11. A mill according to claim 1 wherein said ring is adapted to abut said baffles and to maintain said baffles in a spaced relationship a distance at least substantially equal to the longitudinal thickness of said ring.

12. A mill according to claim 1 wherein at least one of said baffles possesses a substantially frustoconical shape and is inclined relative to said circular, flat plate of said rotor.

13. A mill according to claim 12 wherein the tangent of the angle of inclination is substantially equal to $$\frac{D_2\left(1-\frac{R_2}{R_1}\right)}{R_1-R_2}$$

14. A mill according to claim 1 wherein said faces form substantially equiangular and equidistant chords of said circle.

15. A mill according to claim 1 wherein said faces are integrally fashioned.

16. A mill according to claim 1 wherein each of said baffles possesses an outside diameter substantially equal to the outside diameter of at least one other baffle.

17. A mill for pulverizing rocks and other material comprising:

a plurality of rings, each ring being configured substantially identical to the others of said rings, each ring being disattached from the others of said rings, the inner surface of each ring provided with a plurality of interconnected substantially flat faces, each face substantially coplanar with the chord of a circle whose center substantially coincides with the center of the ring whose inner surface is provided with said faces;

means for maintaining said rings in a substantially vertical column such that said rings are vertically arranged one above the other; and means for forcefully projecting the rocks or other material toward at least one of said faces on the inner surface of each of said rings sequentially from the top-most of said rings to the bottom-most of said rings in a continuous operation.

18. A mill according to claim 17 further comprising at least one substantially circular baffle possessing an interior aperture, said baffle being interposed between two adjacent rings, and wherein said projecting means forcefully projects the rocks or other material toward at least one of said faces on the inner surface of the upper one of said adjacent rings and then forcefully projects the rocks or other material toward at least one of said faces on the inner surface of the lower one of said adjacent rings after the rock or other material has passed through the aperture in said baffle.

19. A mill according to claim 18 wherein said projecting means is provided with at least two rotors, one of said rotors disposed vertically above said baffle and vertically aligned with the upper one of said adjacent rings and the other of said rotors disposed vertically below said baffle and vertically aligned with the lower of said adjacent rings.

20. A mill according to claim 19 wherein said baffle possesses a substantially frustoconical shape and is inclined relative to said rotors.

21. A mill according to claim 20 wherein the tangent of the angle of inclination is substantially equal to $$\frac{D_2\left(1-\frac{R_2}{R_1}\right)}{R_1-R_2}$$

22. A mill according to claim 17 further comprising means for preventing rocks or other material greater than a predetermined size from being forcefully projected by said projecting means against one of said faces on the inner surface of any of said rings.

23. A mill according to claim 17 wherein said faces substantially entirely cover the inner surface of each of said rings.

24. A mill according to claim 23 wherein each of said faces is rectangular and possesses dimensions substantially identical to the dimensions of the others of said faces.

25. A mill according to claim 24 wherein the inner surface of each of said rings is provided with at least seven and less than twelve substantially flat faces.

26. A mill according to claim 17 wherein the inner surface of each of said rings is provided with at least five and less than fourteen substantially flat faces.

27. A mill according to claim 17 wherein said faces of each ring form substantially equiangular and equidistant chords of a circle whose center substantially coincides with the center of said ring.

28. A mill according to claim 17 wherein said faces of each ring are integrally fashioned.

* * * * *